US010889437B1

(12) United States Patent
Altadonna, Jr.

(10) Patent No.: US 10,889,437 B1
(45) Date of Patent: Jan. 12, 2021

(54) REFUSE RECEPTACLE WITH STABLE REMOVABLE LID AND RETAINER

(71) Applicant: Print Cottage LLC, Massapqua Park, NY (US)

(72) Inventor: James Altadonna, Jr., Massapqua Park, NY (US)

(73) Assignee: Print Cottage LLC, Accomac, VA (US)

( * ) Notice: Subject to any disclaimer, the term of this patent is extended or adjusted under 35 U.S.C. 154(b) by 31 days.

(21) Appl. No.: 16/512,215

(22) Filed: Jul. 15, 2019

(51) Int. Cl.
*B65F 1/16* (2006.01)
*B65F 1/14* (2006.01)

(52) U.S. Cl.
CPC ..... *B65F 1/1615* (2013.01); *B65F 1/1468* (2013.01)

(58) Field of Classification Search
CPC ..... B65F 1/1615; B65F 1/16; B65F 1/1468; B65F 1/1473; B65F 1/14; B65D 45/16; B65D 45/00
USPC .. 220/324, 315, 495.06, 495.01, 908.1, 908, 220/212.5, 212; 292/325
See application file for complete search history.

(56) References Cited

U.S. PATENT DOCUMENTS 2,636,639 A * 4/1953 Frey ..... B65F 1/1615 220/318
2,904,986 A 9/1959 Anderson
2,984,511 A 5/1961 Hedrick
2,998,276 A 8/1961 Shettler
3,589,760 A 6/1971 Williams
3,655,034 A * 4/1972 Stollman ..... B65D 81/07 206/454
3,893,725 A 7/1975 Coulter et al.
3,980,202 A 9/1976 Monyak
4,095,830 A 6/1978 Spellman
4,198,087 A 4/1980 Cornell
4,241,846 A 12/1980 Murphy
4,371,092 A * 2/1983 Teague ..... B65D 45/16 220/214
4,413,851 A 11/1983 Ritter
(Continued)

FOREIGN PATENT DOCUMENTS

CA 2406301 A1 4/2004
WO 201568721 A1 11/2015

OTHER PUBLICATIONS

Manuela Williams, "How to Make a Compost Tumbler for Cheap!", acultivatednest.com, Apr. 13, 2009.
(Continued)

*Primary Examiner* — Robert J Hicks
(74) *Attorney, Agent, or Firm* — Alfred M. Walker

(57) ABSTRACT

A trash barrel receptacle includes a detached lid having a predetermined depth, which is held down with an elastic lid retainer. The garbage can and lids use no physical locks or canvas straps, but include the elastic lid retainer, which avoids the need for a pivotable handle located near the top of the garbage can, to lock the lid over the garbage can. The lid has a raised central rib with a concave groove or channel to retain the bungee cord within, to prevent the lid from sliding off laterally off of the refuse barrel. At the inside ends of the central rib are convex bosses molded to fit in grooves at the top of upper skirt of the refuse collection barrel. These bosses align the bungee cord with the retaining proximal and distal securement fasteners and put the cover lid in positional registration with the refuse collection barrel.

23 Claims, 4 Drawing Sheets

(56) References Cited

U.S. PATENT DOCUMENTS

| | | | | | |
|---|---|---|---|---|---|
| 4,421,253 | A * | 12/1983 | Croley | B65D 77/061 206/386 |
| 4,473,170 | A | 9/1984 | Ciancomino | |
| 4,545,501 | A | 10/1985 | Deford | |
| 4,955,501 | A | 9/1990 | Hodge | |
| 4,976,371 | A | 12/1990 | Wise | |
| 5,050,762 | A | 9/1991 | Giorgi | |
| 5,078,295 | A | 1/1992 | Grant | |
| 5,102,001 | A | 4/1992 | Teague | |
| 5,103,994 | A * | 4/1992 | Doxey | B65D 45/20 220/324 |
| D333,715 | S | 3/1993 | Mahler | |
| 5,297,692 | A | 3/1994 | Kronmiller | |
| 5,641,090 | A | 6/1997 | Kowalski | |
| 5,758,914 | A | 6/1998 | Ioveno | |
| 5,774,945 | A | 7/1998 | Ginocchio | |
| D401,719 | S | 11/1998 | Van | |
| D418,655 | S | 1/2000 | Conti | |
| 6,041,960 | A | 3/2000 | Leal | |
| 6,230,920 | B1 | 5/2001 | Porter | |
| 6,390,522 | B1 | 5/2002 | Rucker | |
| 6,722,709 | B2 | 4/2004 | Bergdoll | |
| 6,880,717 | B1 | 4/2005 | O'Conor | |
| 6,902,080 | B2 | 6/2005 | Busch | |
| D519,257 | S | 4/2006 | de Winter | |
| 7,086,557 | B2 | 8/2006 | Miller et al. | |
| 7,121,564 | B2 | 10/2006 | Hassell | |
| D545,024 | S | 6/2007 | Liao | |
| D555,321 | S | 11/2007 | Lin | |
| 7,909,199 | B2 | 3/2011 | Cahill | |
| D683,512 | S | 5/2013 | Quan | |
| 8,459,487 | B2 | 6/2013 | Sharma et al. | |
| 8,691,257 | B2 | 4/2014 | Hartman | |
| 9,205,953 | B2 | 12/2015 | Andrews | |
| D767,387 | S | 9/2016 | Wyatt | |
| 9,856,079 | B2 | 1/2018 | Manssourian | |
| 10,294,022 | B2 | 5/2019 | Blazer et al. | |
| 2007/0175898 | A1* | 8/2007 | Craft | B65F 1/1615 220/324 |
| 2008/0168289 | A1 | 7/2008 | Dawn | |
| 2010/0224634 | A1* | 9/2010 | Mays-Hornung | B65F 1/0006 220/495.11 |
| 2011/0132801 | A1* | 6/2011 | Elder | B65D 19/18 206/600 |

OTHER PUBLICATIONS

"Strong Strap TM," blazerbrand.com, 2019.
"Bin Strap Garbage Lock Trash Can Lid," amazon.com, 2019.
"Lid Loc," amazon.com, 2019.

* cited by examiner

Fig. 1
(Prior Art)
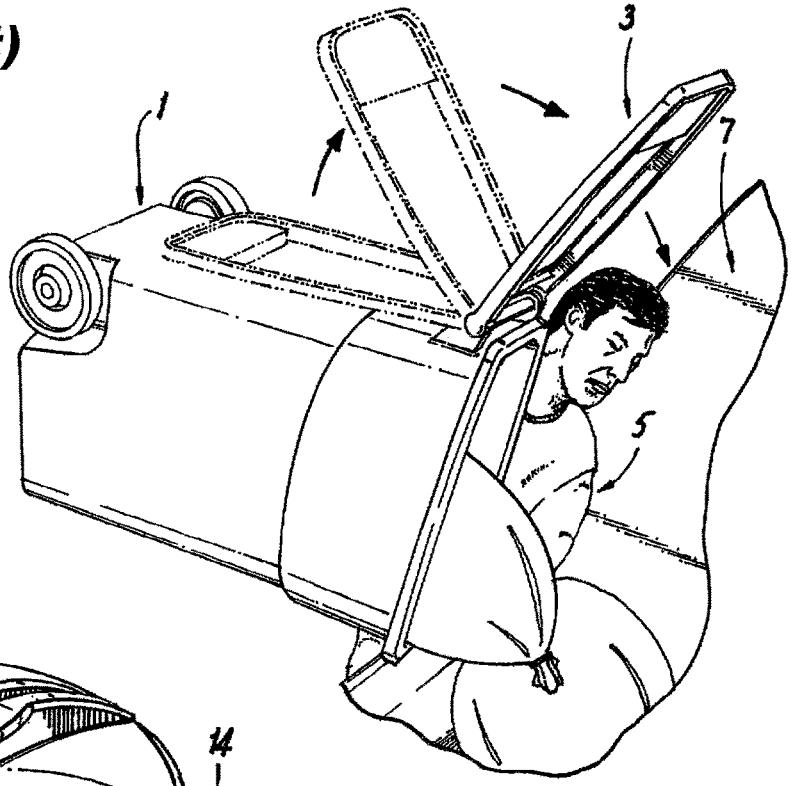
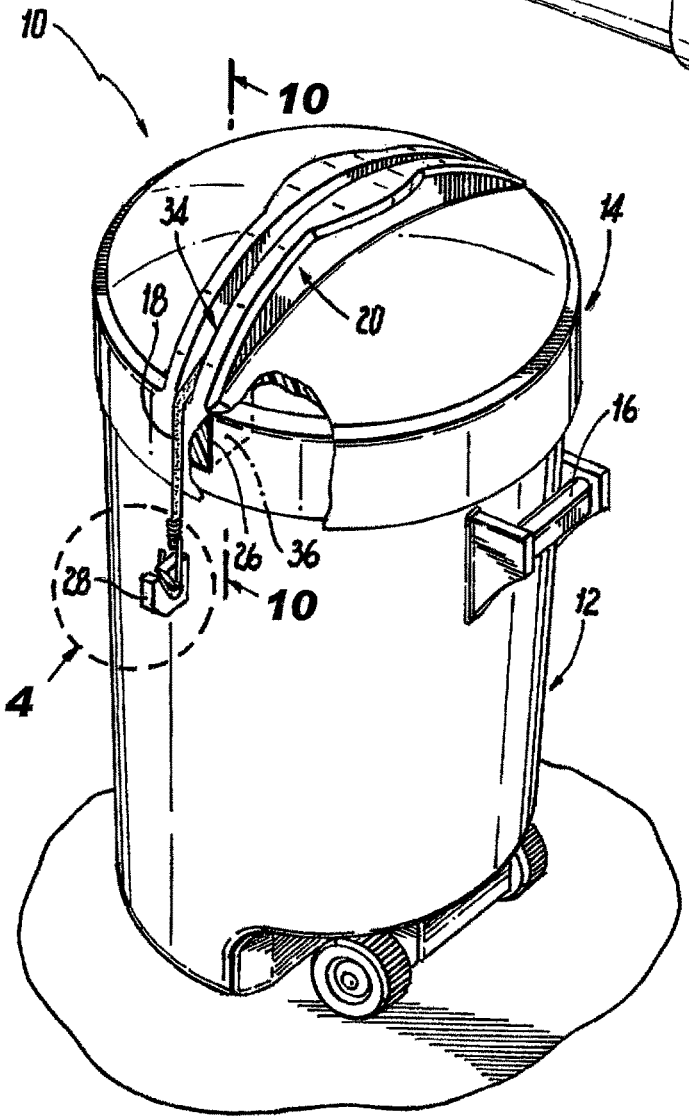
Fig. 2

REFUSE RECEPTACLE WITH STABLE REMOVABLE LID AND RETAINER

FIELD OF THE INVENTION

The present invention relates to safe removable retainers for garbage can lids, using no physical locks or canvas straps, but with a boss and groove lid retainer, which avoids the need for a pivotable handle located near the top of the garbage can, to act as an interlock for locking the lid over the garbage can in a locked position.

BACKGROUND OF THE INVENTION

Lids which are not pivoted or tethered to the garbage can often do not fit the top of the garbage can after time or after having been crushed by traffic on the road before the garbage can and lid are retrieved from the roadside by the homeowner.

Efforts have been made to permanently tether the lid to the can by a pivot joint or by a flexible tether. However, tethered or pivotable lids with hinges require complicated buckles or other fasteners, and interfere with the sanitation worker's swift lifting and inverting the garbage can's refuse contents into the garbage truck bin. An attached hinged lid could move against the sanitation worker's arm or hands, and interfere with dumping, or worse, could spring back and hit the sanitation worker in the face or eyes while dumping the refuse contents into the bin of the garbage truck.

Prior art patents disclose attaching lids to garbage cans with elastic members (cords or straps) in U.S. Pat. No. 6,880,717 of O'Conor, U.S. Pat. No. 4,545,501 of DeFord, U.S. Pat. No. 6,722,709 of Bergdoll and U.S. Pat. No. 5,758,914 of Ioveno '914.

For example, O'Conor '717 uses an elastic strap 22 to retain a hinged lid upon a refuse receptacle, but the strap 22 does not go all over the top of the lid 14 for the garbage can 12. O'Conor '717 also requires a complicated buckle 30a, 30b, which can interfere with a sanitation worker's swift dumping of a garbage can's refuse into the bin receptacle of a garbage truck.

Related thereto, Bergdoll '709 discloses holding a lid 12 to a top of a garbage can 14 via the use of two "flexible" tension rods 11, such as elastic bungee cords. However, Bergdoll '709 has complicated anchor portions 24 to anchor the flexible tension rods 11 in place to the handles 16, 18 of the garbage can 14.

Additionally, Ioveno '914 discloses attaching an elastic bungee cord 12 via opposite end alligator clips 14A, 14B to the handle 8 of a garbage can 2, where the bungee cord 12 goes through the handle 6 of the lid 5. However, in Ioveno '914, the lid 5 is tethered by the bungee cord to the garbage can 2 itself, which can interfere with the sanitation worker's lifting and dumping of the can, or the lid could possibly swing back and strike the sanitation worker.

Moreover, DeFord '501 discloses use of a flexible elastic strap 21 which locks the lid 12 over a top region of the smooth cylindrical garbage can 10. However, the strap 21 of DeFord is connected by snap fasteners to the opposite handles 14 and 16 of the garbage can 10 of DeFord, so the sanitation worker has to take the extra time to lift the strap 21 by its centrally located handle 38, and slide the handle 38 and strap 20 down to that they stay horizontally against the side of the garbage can 10, as shown in FIG. 3 of DeFord '501. At that point, the sanitation worker is free to lift the lid 12 off of the garbage can 10, and then lift and invert the garbage can 10 to dump its refuse contents into the collection bin of the garbage truck.

U.S. Pat. No. 4,473,170 of Ciancimino describes using a bendable cable 62 to connect a lid 34 to a garage can 12. However, the bendable cable 62 is permanently attached to the handle 46 of the lid 34 via a nut 52 and bolt 56 that penetrate and hold an eyelet 48 through which the bendable cable 62, thereby permanently tethering the lid 34 to the garbage can 12.

For example, U.S. Pat. No. 7,909,199 of Cahill permanently tethers a lid 21 to a garbage can 20 with a connecting bungee cord 50, permanently attaching the lid 21 to the garbage can 20.

Cahill '199 discloses permanently attaching an elastic bungee cord between the lid and the garbage can, but Leal '960 attaches an elastic bungee cord 12 permanently to an eyelet fastener 52 on one side of garbage can 40 and a removable hook 32 at the other end of the bungee cord 12 to attach it to another eyelet fastener 54 on the other side of the garbage can 40. The bungee cord 12 in Leal '960 is attached to the lid via a hollow eyelet bolt 20 on the top of the lid 42.

U.S. Pat. No. 5,004,114 of Terbusch is similar to Cahill '199, but with a rigid C-shaped member (not elastic) to permanently attach the lid to the garbage can.

U.S. Pat. No. 6,041,960 of Leal, like Ciancimino '170 and Cahill '199, permanently attaches an elastic bungee cord 12 or 70 to a lid 42 of a garbage can 40 by providing an eyelet 20 or 80 bolted to the lid 42 or 94 through which the bungee cord 12 or 70 is threaded, thereby permanently tethering the lid 42 or 94 to the garbage can 40 or 80. But Leal '960 requires conventional circumferential tongue and groove molding to lock the garbage can.

Additionally, the Canadian patent '301 of Walker discloses using the opposite sided locking handles 28 to be attached to buckles 68 at opposite sides of a flexible strap 54 to press against a lengthwise and upwardly extending ridges 16, against which the force of the flexible strap 54 is applied, to retain the lid 12 on top of the garbage can 10. However, the Canadian patent '301 has complicated and time-consuming buckles 68 to be unlatched, which delay the time required to quickly remove the lid 12 from the garbage can 10 to invert the can 10 and dump the refuse contents of the can 10 into a garbage truck bin.

US Patent application publication No. 2008/0169289 of Dawn discloses a central diameter extending recess channel groove 62, extending across the middle of a circular lid 14 of a garbage can 20 to hold an elastic strap in place, to temporarily secure the lid 14 on top of the garbage can 20. Dawn '289 also discloses an elongated flexible flat strap 60. The strap 60 is attached by either magnets 96 or by Velcro® hook and loop fasteners 76, 78 at one end to connectors 59 on each opposite side of the garbage can 29. Release of the lid 14 from the garbage can 20 of Dawn keeps the lid untethered and away from the sanitation worker, however, the recessed channel provided across the top of the lid is shallow and wide, and does not provide any alignment for keeping the lid on top of the garbage can. In fact, Dawn '289 requires opposite triangular fasteners to align and keep the lid in place.

An advertisement for a brand name "Lid Loc" discloses permanently holding the lid of a garbage can with an elastic bungee cord, that wraps around half of the lid and attaches by the loop of the bungee cord wrapped over a hook on the side of the garbage can. But it discloses a tethered lid which is permanently tethered to the garbage can, which can possible swing and strike a sanitation worker trying to dump refuse from the garbage can.

U.S. Pat. No. 10,294,022 of Blazer describes a lid 36 of a garbage can 30 which uses a strap 1 to be locked in a lockable anchor 2 located on the side of the can 30. Blazer '022's anchor may be cumbersome and complicated for loosening the strap 1 from the lockable anchor 2.

U.S. Pat. No. 9,856,079 of Manssourian discloses attaching a lid 112 to a garbage can 104 with an adjustable belt 112, but Manssourian requires a pivoting retainer arm 206 of a retainer 110, and the lid 106 is permanently and pivotably attached to the garbage can 114.

Another refuse receptacle with a permanently attached pivoting lid is disclosed in U.S. Pat. No. 8,459,487 of Sharma, which also describes a strap with buckles attached to a refuse receptacle lid, where the buckles need to be loosened and opened to lift the attached, pivotable lid from the refuse receptacle.

Also, among other garbage cans with permanently attached, pivotable lids is disclosed in U.S. Pat. No. 8,691,257 B2 of Hartman, et al. discloses a downwardly extending flexible tongue strap engageable with a padlock. But the lid 302 is permanently and pivotably attached to the garbage can 322 of Hartman '257.

U.S. Pat. No. 7,121,564 B2 of Hassell also describes a pivoting lid locking portion 18 attached to a lid 24 and to a garbage can 12.

U.S. Pat. No. 7,086,557 B2 of Miller, et al., discloses attaching a pivoting lid to a garbage can via two (2) bungee cords with distal end locks 29 that lock to lock holes 24 of the lid. The bungee cords with fasteners 27 are permanently attached to the lid 5, which is pivotably attached to the garbage can 40. A similar trash bin 12 of U.S. Pat. No. 4,955,501 of Hodge has two adjacent lids 14, 16, which are permanently and pivotably attached to one edge of the trash bin 12, where elastic cords 50 are attached to and through apertures of lugs and fasteners on the trash bin 12.

U.S. Pat. No. 6,902,080 B2 of Busch, like Hartman '257, is similar to the aforementioned lid lock 14 which includes downwardly extending tongue 18 that also engages a padlock to lock a pivotably attached lid 14 to a garbage can 12.

U.S. Pat. No. 6,230,920 B1 of Porter describes a cage-like assembly 10 with a sunburst pattern of straps 14 to hold a lid in place upon a garbage can.

U.S. Pat. No. 5,641,090 of Kowalski discloses using molded plastic edges of a lid to lock it to a garbage can.

U.S. Pat. No. 5,297,692 of Kronmiller discloses retaining a lid 11 to a garbage can 12 via an elastic strap 21 to access the lid. But Kronmiller does not discuss the use of a spanning elastic strap 21 across the lid, but where the strap 21 is not using a recess channel to stabilize the lid of the garbage can. However, in Kronmiller '692, one proximal end of the flexible strap is looped around one of the handles of the garbage can and the distal end has Velcro® hook and loop fasteners to wrap the distal end of the strap around the opposite handle on the other side of the garbage can and fasten the strap firmly in place, exerting holding force against the lid of the garbage can. However, Kronmiller '692's flimsy VELCRO® hook and loop fasteners, can inadvertently disconnect.

U.S. Pat. No. 5,102,001 of Teague discloses a strap clip 26 which wraps partially around a lid to hold a non-analogous sealed container to its lid.

U.S. Pat. No. 5,078,295 of Grant discloses two flexible spring cords that wrap around a lid 12 to hold it and tether it permanently onto a garbage can 11.

U.S. Pat. No. 5,050,762 of Giorgi describes a molded lockable lid for connecting securely to a molded non-smooth surfaced top protruding circumferential horizontally extending ridge of a garbage can.

U.S. Pat. No. 4,976,371 of Wise, et al., discloses locking a lid to a garbage can via use of an encircling belt 24 having a flexible strap 28 with VELCRO® locking pads, to temporarily hold a garbage can lid 14 firmly on top of a garbage can 10.

U.S. Pat. No. 4,413,851 of Ritter discloses use of a strap 17 with a snap buckle 26 and opposite snap fastener 28, 29 to lock a lid 31 over a garbage can 32. The strap 17 is threaded through or around the lid handle 15 or 35.

U.S. Pat. No. 4,241,846 of Murphy discloses wrapping a flexible chain 29 with a spring portion 41 around a lid 65 to lock it to a garbage can 59. The chain 29 is threaded through the lid handle 63. A similar cord and spring combination to hold a garbage can lid to the handles o a garbage can is disclosed in U.S. Pat. No. 3,589,760 of Williams. However, the garbage can lids of Murphy and Williams do not have deep, narrow recessed channels to orient and hold the flexible locking members in place upon the respective lids of Murphy '846 and Williams 760.

U.S. Pat. No. 4,198,087 of Cornell discloses using a pivoting metal bar and a padlock to semi-permanently lock and tether a lid cover 11 to a garbage can 12.

U.S. Pat. No. 4,095,830 of Spellman discloses an animal-proof lock for a garbage can lid comprising of three-pronged elastic strap 7 with distal end loops 9 to engage mounted hooks 28 on adjacent post 18 and to side handles 14 of a garbage can 10.

U.S. Pat. No. 3,980,202 of Monyak, et al. discloses a garbage can cover retainer that includes a flexible strap 11 with a pair of lockable rings 17, 19 at opposite ends thereof, to engage a handle of the garbage can at one end, and to engage a lid handle of the garbage can lid at the other end of the flexible strap, so that the lid 25 is semi-permanently tethered to the garbage can 27.

US Design Pat. No. 333,715 of Mahler describes a garbage can lid having a plurality of elastic cords permanently attached to a garbage can lid handle, with distal end hooks that a permanently and pivotably attached to the peripheral circumferential edge of the lid, to pivot and lock a corresponding lip of the upper edge of a garbage can.

U.S. Pat. No. 6,390,522 of Rucker describes a rigid, bent tubular rod that goes through two upright handles of a garbage can, to press down upon a lid atop the garbage can.

U.S. Pat. No. 9,205,953 B2 of Andrews describes a garbage can with a pair of wide shallow rectangular cutouts at an upper edge thereof, to be used to hold pieces of rectangular cross sectional shaped planks of lumber, to form a retrofit saw horse with a garbage can base.

International PCT application publication No. WO2015/168,721 A1 of McPherson and Padlock Pty Ltd., both of Australia, describes a tether 14 that attaches at one end to a garbage can lid 110 and at the other end to a garbage can 100, so that the lid 110 is tethered semi-permanently to the garbage can 100.

The same is true with the aforementioned Ciancimino '170 patent, where the top shoulder 16 of a can 12 is closed by a lid 34 locked by a flexible metal cable 62.

Cahill '199, Bergdoll '709 and Ioveno '914 each semi-permanently tether the lid to the garbage can, which can be inconvenient and/or unsafe to a sanitation worker in danger of being struck by the tethered lid while attempting to dump the refuse contents from the garbage can into the bin of a garbage truck.

A reference in a non-analogous field of technology is U.S. Pat. No. 5,774,945 of Ginocchio, which describes a bundling device to bundling a plurality of objects, where an integrally affixed elastic cord is affixed to a wedge support member with a handle, where channels are provided with diameters less than the diameter of the elastic cord, so that the cord is tightly gripped therein.

The aforementioned patents do not provide simple hook and eyelet connections, which can more quickly and safely release a bungee cord from the lid of the garbage can, than releasing the snap locks of DeFord '501 or the Velcro® hook and loop fasteners of Kronmiller '692 or of Dawn '289, from their respective lids of their respective garbage cans.

OBJECTS OF THE INVENTION

It is therefore an object of the present invention to provide a garbage can receptacle combination with a barrel and removable lid, which is held in place by an upwardly extending rib having handle parts for grasping and a central concave recess channel which presents a partial convex mirror image bosses underneath, to mate with corresponding concave cutouts in the top edge of the upper skirt of the receptacle barrel.

It is also an object of the present invention to provide a garbage can receptacle with a smooth surfaced upper skirt provided at a top edge thereof, preferably having depth of 4 to 5 inches, over which is placed a smooth surfaced lower skirt descending from a garbage can receptacle lid, preferably also having a depth of 4 to 5 inches.

It is yet another object to provide a garbage can receptacle and removable lid, which are optionally aligned in place and held securely in place via an elastic securement cord, such as a bungee cord.

It is also an object of the present invention to provide a lid retainer which allows for removal of the lid, without being pivotable attached and providing the problem of the pivoting or tethered lid striking the sanitation worker as the worker is lifting the garbage can and dumping the contents therefrom.

Other objects which become apparent from the following description of the present invention.

SUMMARY OF THE INVENTION

In keeping with these objects and others which may become apparent, the present invention is directed to garbage cans having skirts with smooth curved surfaces located on upper exterior portions thereof, where the skirts extend 4 to 5 inches at the top of the garbage can, and the garbage can is provided with a removable cover lid having a descending corresponding skirt, also with smooth curved surfaces located thereon, descending to a depth of about 4 to 5 inches in depth, fitting loosely but smoothly against the skirt located at the corresponding upper exterior portion of the garbage can, which can be circular or rectangular in cross section.

More importantly, the lid is provided with a handle comprising a raised central rib having convex bosses molded underneath, to fit in and lock to respective cutout grooves at the top of the upper smooth surfaced skirt of the refuse collection garbage can, to keep the lid secure and locked in place on the garbage can.

The lid is not tethered or joined to the garbage can, but is removable and optionally can be further temporarily retained in place by an elastic member such as, for example, a "bungee" cord, which is removable attached by an integral molded base to the exterior of the garbage can at a location on the exterior of the garbage can, below the 4 or 5 inch depth of the smooth surfaced skirt of the lid, and on an opposite back side surface of the garbage can from where the handle is typically located.

An optional attached or molded-in retaining eyelet or hook is provided, to which the distal loose end of the elastic retaining bungee cord is engaged manually by the homeowner, to further temporarily retain the lid upon the garbage can before it can be loosened away from the garbage can by wind or wild animals.

Optionally the raised central rib has a built-in recess track channel of approximately 1 to 2 inches in depth on the top of the lid, so that the homeowner can guide the elastic cord therethrough, from its attachable proximal end on the rear of the garbage can, over the top of the lid, through the recessed channel, and then to the eyelet or other retaining hook on the front of the garbage can, just above the handle, whereby the bungee cord is secured in place within concave recess channel, preferably having a narrow width of about one half to three quarters of an inch.

At the inside ends of the raised central rib are the aforementioned bosses, preferably convex shaped bosses, which are molded to fit in and lock to the concave grooves at the top of the upper skirt of the refuse collection barrel, to keep the lid secure on the barrel, regardless of the presence of the bungee cord. These bosses also optionally align the bungee cord with retaining proximal and distal securement fasteners of the bungee cord and put the cover lid in positional registration with the barrel of the barrel receptacle combination.

The cover lid preferably has a depth of about 4 to 5 inches in depth "D," fitting loosely but smoothly via cover skirt fitting over the corresponding barrel skirt at the top end of barrel 12. The depth "D" is several inches deeper than the conventional 2 inch depth of conventional garbage can lids. The convex bosses molded to fit in the concave grooves located at the top of the upper smooth surfaced skirt of the barrel. These convex bosses are mirror images of the lower concave portions of the walls forming the concave recess channel located within the raised rib of the cover lid. These bosses align the bungee cord with the retaining proximal and distal securement fasteners on opposite side of the barrel and put the cover lid in positional registration with the refuse collection barrel.

Respective ergonomic left and right cover handles are preferably integrally molded at a central region of the raised central rib to facilitate manual grasping by the user.

As a result, the sanitation worker can conveniently, remove the lid and grab the garbage can by the handle, invert it and dump the refuse therefrom into the sanitation truck hopper storage compartment for transport to a refuse collection site, without concern that a pivoting lid attached permanently to the garbage can strike the sanitation worker during the process of lifting and dumping the contents of the garbage receptacle into a collection bin at the rear of a garbage collection truck.

If the garbage can and lid have the optional bungee cord aligned within the recess channel of the raised rib of the cover lid, the sanitation worker can quickly detach the elastic cord before removing the cover lid from the garbage can, prior to dumping the contents therefrom into the collection bin at the rear of the garbage collection truck.

The garbage barrel of the present invention therefore also does not need a complicated molded, non-smooth surfaced tongue and groove lock to be provided to the lid and to the top of a garbage can.

BRIEF DESCRIPTION OF THE DRAWINGS

The present invention can best be understood in connection with the accompanying drawings. It is noted that the invention is not limited to the precise embodiments shown in the following drawings, in which:

FIG. 1 is a prior art perspective view of a trash collector dumping a barrel receptacle into the hopper of a truck, risking injury to his head due to a potential rotation of the hinged lid.

FIG. 2 is a top perspective view of the trash barrel receptacle of the present invention, shown in a sealed and secured position due to the connection of respective bosses extending down from the lid to respective cutout grooves in the top of the barrel receptacle, as well as from the bias of an optional bungee cord within an optional channel recess provided in a raised rib handle portion of the lid.

DETAILED DESCRIPTION OF THE DRAWINGS

The present invention has broad applications to many technical fields for a variety of articles. For illustrative purposes only, a preferred mode for carrying out the invention is described herein, wherein a trash barrel receptacle utilizes a cover lid, including a locking connection of respective bosses extending down from the lid to respective cutout grooves in the top of the barrel receptacle, as well as an optional elastic securement retainer for the cover lid.

The outdoor trash barrel of this invention has a cover lid and cover lid retainer that is convenient for the homeowner as well as the trash collector. Injury exposure to sanitation workers engaged in manual dumping operations into trucks is minimized.

FIG. 1 depicts a sanitation worker 5 manually dumping the contents of a trash barrel into the hopper of a truck 7 using a prior art trash barrel receptacle 1 with a pivoted cover lid 3. It is noted the potential for injury by the moving cover lid 3 potentially striking the sanitation worker 5 while the sanitation worker quickly lifts and inverts the barrel for dumping refuse therefrom into a bib collector of a sanitation truck.

Figure 3:
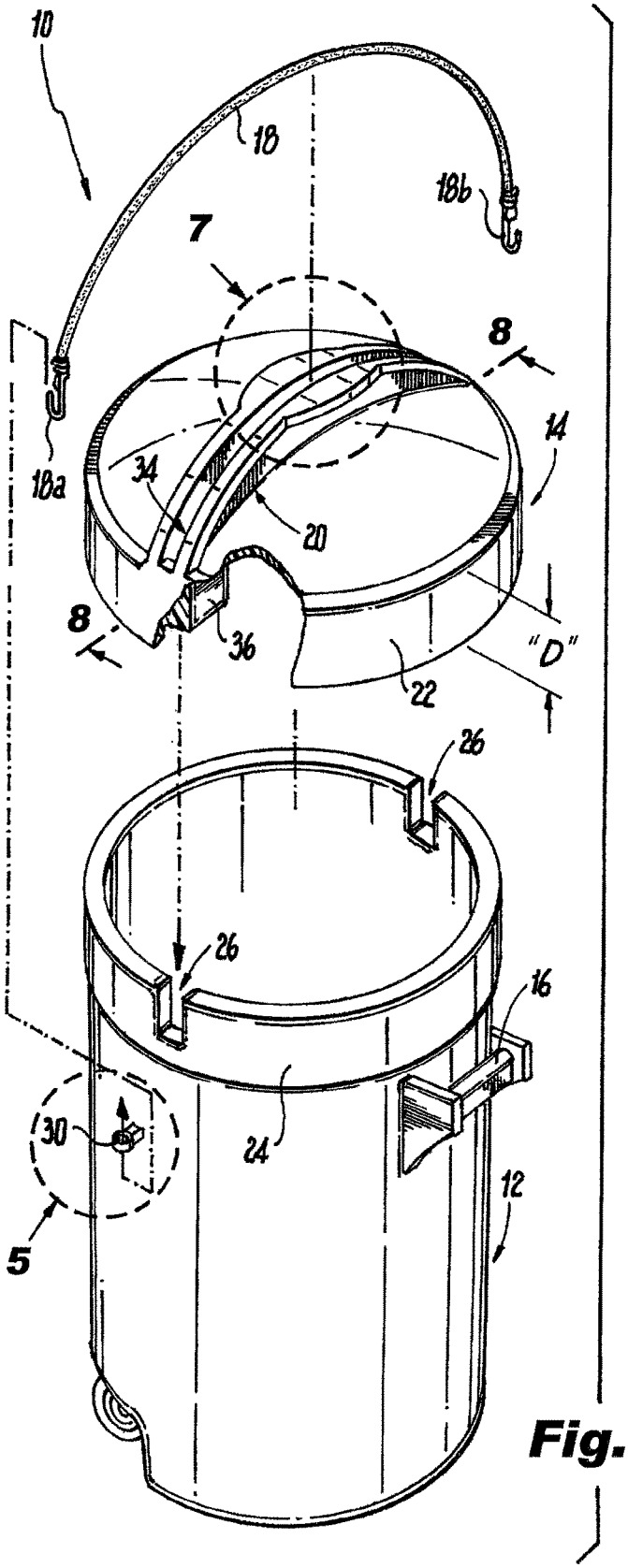
FIG. 3 is an exploded perspective view of the barrel receptacle, lid, and optional bungee cord of the present invention, the lid shown in partial cutaway to show the alignment of the boss and groove of one side.
Figure 11:
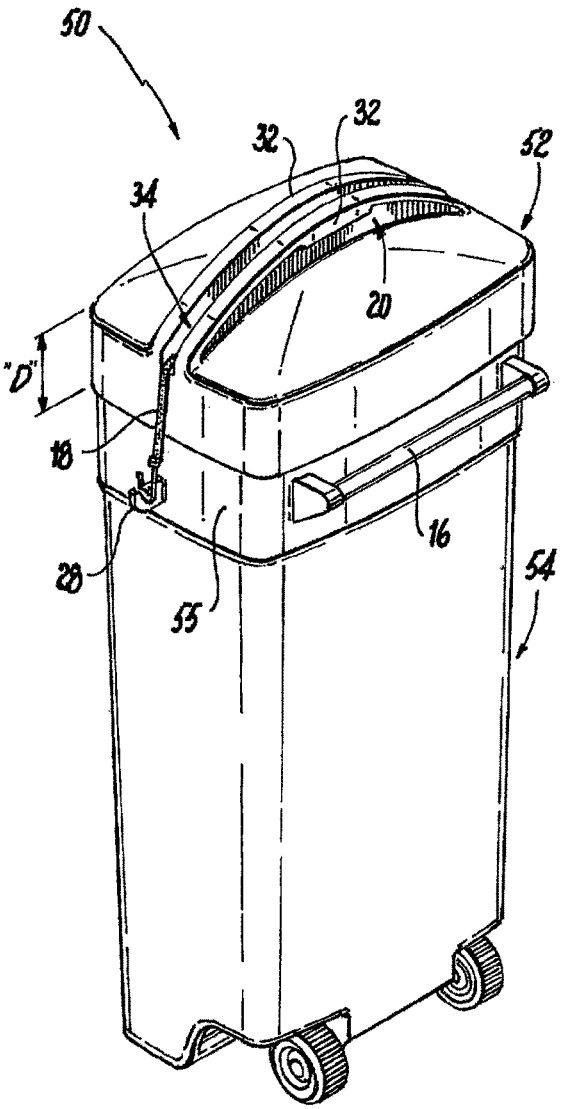
FIG. 11 is a perspective view of an alternate trash barrel receptacle, shown in a sealed and secured position due to the connection of respective bosses extending down from the lid to respective cutout grooves in the top of the barrel receptacle, as well as from the bias of an optional bungee cord within an optional channel recess provided in a raised rib handle portion of the lid, due to the bias of the optional bungee cord.
Figure 12:
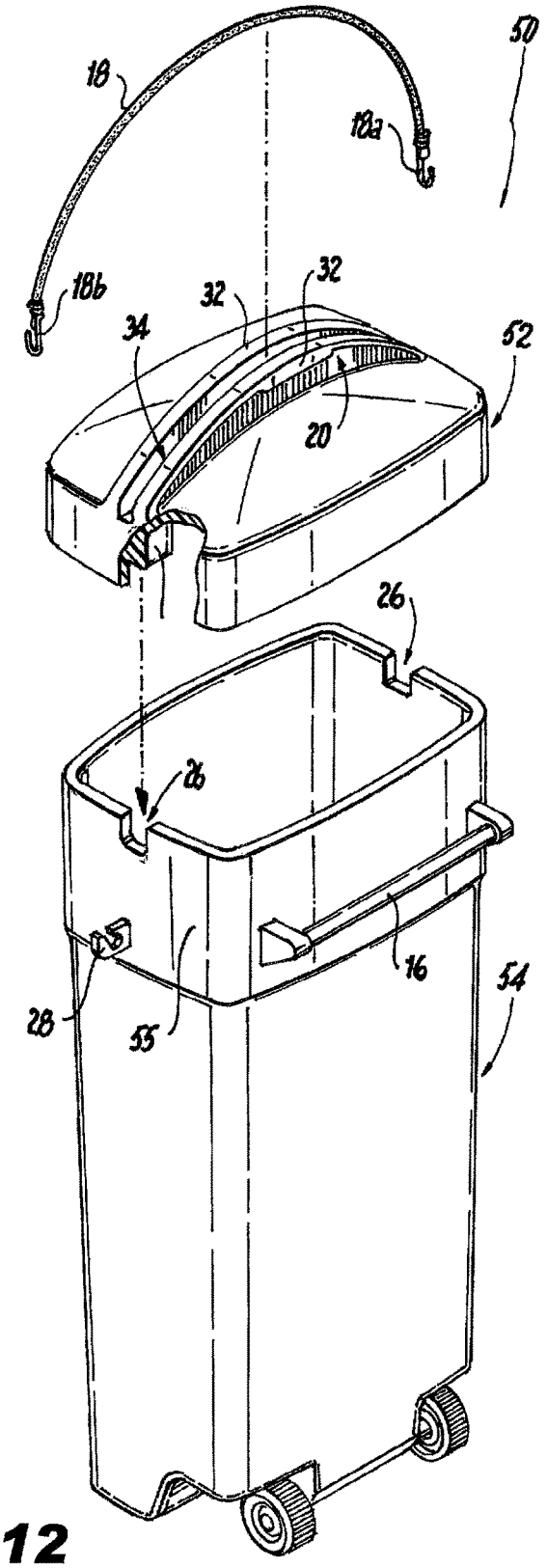
FIG. 12 is an exploded perspective of the barrel receptacle, lid and optional bungee cord of the barrel receptacle of FIG. 11, shown in partial cutaway to show the alignment of the boss and groove of one side.

The first embodiment of the present invention shown in FIGS. 2 and 3 is for a trash barrel receptacle combination 10 with a barrel 12 that is essentially round in cross section while a second embodiment shown in FIGS. 11 and 12 illustrates an essentially rectangular cross section trash barrel receptacle combination 50 with comparable features, such as barrel 54 and cover lid 52.

FIG. 2 shows a sealed round cross section trash barrel receptacle combination 10 of this invention with barrel 12, and removable cover lid 14, which is lockably connected to the top shirt of barrel 12 with protruding bosses 36 engageable with cutout grooves at the top of barrel 12, and which is further optionally held down with an expandable elastic securement element, such as an optional bungee cord 18, where the optional bungee cord 18 is secured in place within optional concave recess channel 34 extending axially lengthwise within a raised rib handle portion 20 of the barrel 12, where the concave recess channel 34 preferably has a narrow width of about one half to three quarters of an inch.

FIG. 3 is an exploded view of the same trash barrel receptacle combination 10 showing the components more clearly. FIG. 3 shows the barrel 12 oriented and rotated 180 degrees than how barrel 12 is shown in FIG. 2. It is noted that cover lid 14 is show in FIG. 3 having a depth of about 4 to 5 inches in depth "D", fitting loosely but smoothly via cover skirt 22 fitting over barrel skirt 24 at the top end of barrel 12. The depth "D" is several inches deeper than the conventional 2 inch depth of conventional garbage can lids. Barrel side handle 16 can be either molded in place, or it can be pivotable. An optional quick-disconnect/connect bungee cord securement fastener 28 is molded to one side of barrel 12 (as shown in the enlarged close-up detail view in FIG. 4). The optional molded securement fastener 28 extends outwardly from the outer surface of barrel 12. In order to hold the proximal end hook **18*b* of the optional bungee cord 18 in place, a slot extends preferably partially and slanted at a downward angle from the top of securement fastener 28, towards the outer surface of barrel 12. This type of structural configuration of the slot can mate with the bungee cord proximal fastener end 18*b*, to hold proximal end hook 18*b* in place indefinitely, or the proximal end hook 18*b* can be removed by the user each time used, if preferred by the user. It is further noted that use of the bungee cord 18 is optional, since the lid 14 can be lockable in place to the top of the barrel 12 by virtue of the engagement of the downwardly extending bosses 36 of the cover lid 14 with corresponding cutout grooves 26 at the top of the barrel 12**.

Figure 5:
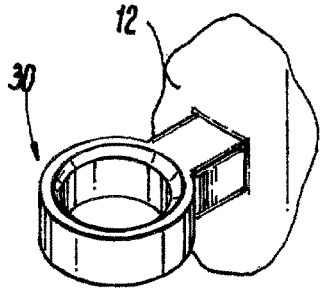
FIG. 5 is a local perspective a second optional bungee hook securement means, comprising an eyelet.
Figure 6:
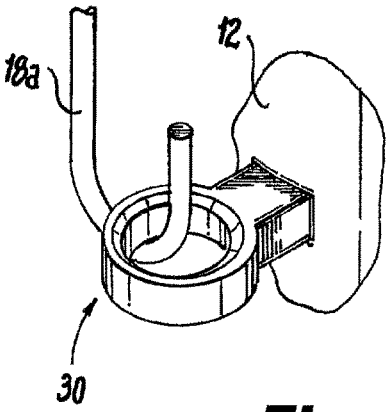
FIG. 6 is a local perspective view, taken at arrow 6 of FIG. 2, showing the optional eyelet of FIG. 5, with an optional bungee hook contained therein.

As shown in FIGS. 5 and 6, a different optional securement fastener 30 is provided, for quick and convenient dislodging of distal end hook **18*a* of the optional bungee cord 18 by a sanitation worker, immediately before lifting the cover lid 14 off of the barrel 12. Securement fastener 30 is located on an opposite side of barrel 12, which is preferably an eyelet, wherein the eyelet is a safer option than a hook. The opposite distal fastener end 18***b* of optional bungee cord 18 is retained in annular eyelet 30, as shown in close-up detail views of FIGS. 3, 5 and 6 on the opposite side to securement fastener 28. Since bungee cord 18 is optionally used to deter animals' access to the contents of barrel 12 of barrel receptacle combination 10, the homeowner may wish to keep it attached to eyelet 30 even when not in use to prevent loss. In such cases, the distal end fastener open hook 18*b* shown in FIG. 6 can be easily replaced with a snap hook or other closed retainer.

Figure 7:
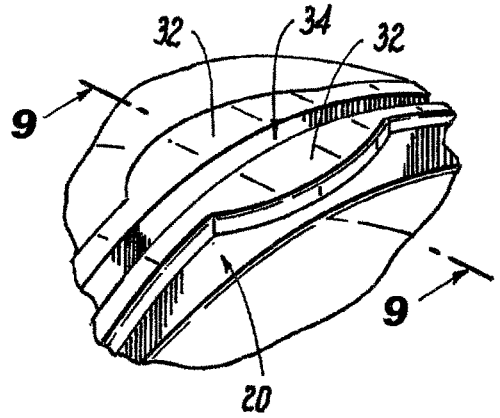
FIG. 7 is a local perspective view, taken at arrow 7 of FIG. 3, showing the top portion of the lid with the groove and handle detail disposed thereon, including optional outwardly extending manual graspable handle tabs.
Figure 8:
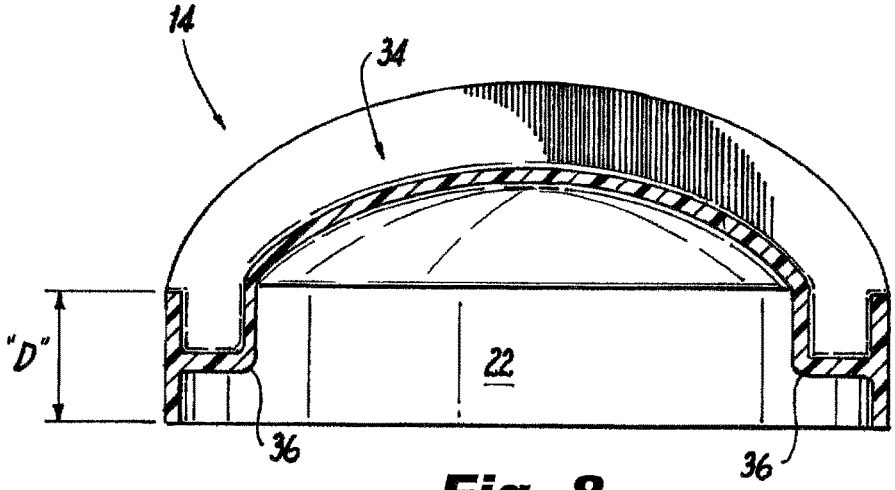
FIG. 8 is sectional elevation taken at cutline 8-8 of FIG. 3, showing the groove, skirt and bosses molded integrally with the lid.
Figure 9:
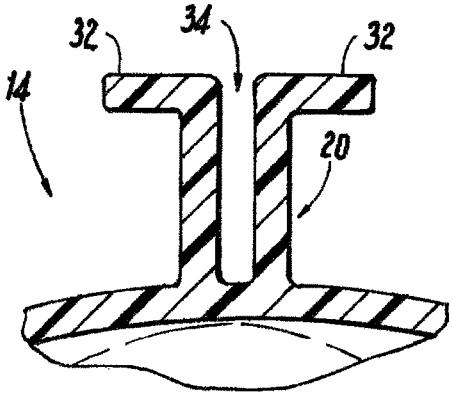
FIG. 9 is a sectional elevation taken at cutline 9-9 of FIG. 7, showing the groove and upper handle tabs of the raised rib molded integrally with the lid.
Figure 10:
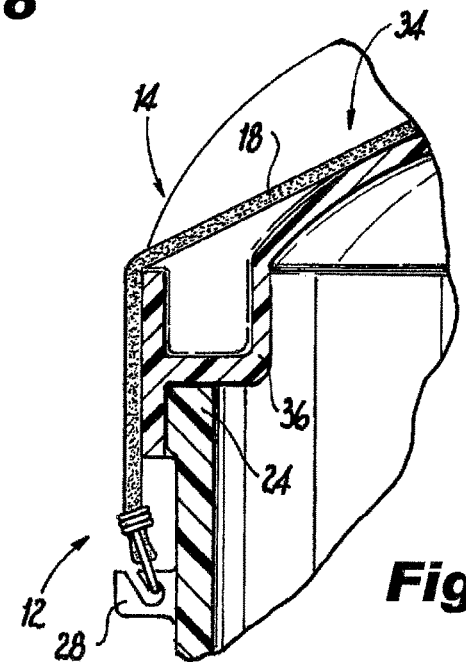
FIG. 10 is a side sectional elevation, taken at cutline 10-10 of FIG. 2, showing the lid attached to the barrel receptacle via a boss seated within a groove in the barrel receptacle; and showing an optional elastic cord attached to a securement fastener on the barrel receptacle.

The remaining details are regarding the handling of the optional bungee cord 18 and the fit of the cover lid 14 and barrel 12 of the barrel receptacle combination 10. Cover lid 14 has a raised central rib handle 20 with a an optional concave groove or channel 34 to retain the optional bungee cord 18 within (if used), when it is in use to prevent cover lid 14 from sliding off laterally off of barrel 12 of barrel receptacle combination 10. While this feature can be seen in FIGS. 2 and 3, central enlarged view of FIG. 7 and sectional views of FIGS. 8 and 9 are more revealing. At the inside ends of central rib feature 20 are convex bosses 36, molded to fit in concave grooves 26 (see FIG. 3) at the top of smooth surfaced upper skirt 24 of barrel 12. Although they could be provided extending down from raised rib handle 20 without a concave groove or channel recess 34, these convex bosses 36 are preferably convex mirror images of the lower concave portions of the walls forming the concave recess channel 34 of the cover lid 14. These bosses 36 also align the optional bungee 10 and 18 with the retaining proximal and distal securement fasteners 18*a* and 18*b* and put the cover lid 14 in positional registration with the barrel 12 and lock the lid 14 to the barrel 12, of the barrel receptacle combination 10, with or without the optional elastic bungee cord 18 and optional channel 34 of raised rib handle portion 20.

FIG. 8 also shows that cover lid 14, as is also shown in FIG. 3, as having the smooth surfaced skirt 22 with depth "D" of about 4 to 5 inches in depth, so that cover lid 14 with cover skirt 22 fits smoothly and firmly over barrel skirt 24 at the top end of barrel 12. FIGS. 7 and 9 are close-up detail views that show left and right cover handles 32 which are integrally molded with raised central rib 20, and which are preferably arcuate at their outer edges, to facilitate manual grasping by the user. As also shown in FIGS. 7 and 9, cover lid 52's raised central rib 20 also includes left and right cover handle tabs 32, which are preferably arcuate at their outer edges, to facilitate manual grasping by the user, which are integrally molded with raised central handle rib 20. Preferably cover handle tabs 32 comprise a pair of centrally located outwardly extending cantilevered flanges, each cantilevered flange extending in a opposite direction to provide opposite gripping surfaces for manually handling the lid 14.

FIGS. 11 and 12 show a second embodiment of this invention using a trash barrel receptacle 50 with generally rectangular cross section. Cover lid 52 seals barrel receptacle 54 using optional bungee cord 18 and all of the hardware and techniques of the first embodiment shown in FIGS. 1-10. For example, cover lid 52 also has a descending, smooth surfaced skirt having a deeper depth "D" than conventional lids having depths of about 2 inches, which slides over a smooth surfaced upper skirt with a similar corresponding depth "D" at the top of barrel receptacle 54. Although cover lid 52 can be locked in place by virtue of bosses 36 of lid 52 engaging cutout recess grooves 26 on the top of barrel receptacle 52, cover lid 52 also has a raised central rib handle 20 with an optional concave groove or channel 34, to retain optional bungee cord 18 within, to further prevent cover lid 52 from sliding off laterally off of trash barrel 54 of barrel receptacle combination 50. The optional concave recess channel 34 also preferably has a narrow width of about one half to three quarters of an inch.

As also shown in FIGS. 2, 3, 7, 8 and 9, the central rib 20 also has convex bosses 36 molded to fit in grooves 26 at the top of upper skirt 55 of rectangular shaped barrel 54, for aligning and locking lid 52 to barrel receptacle 54. These bosses 36 also align the optional bungee cord 18 with the optional retaining proximal and distal securement fasteners 18*a* and 18*bs*, and also put the cover lid 52 in positional registration with the rectangular barrel 54. As also shown in FIGS. 7 and 9, cover lid 52's raised central rib 20 also preferably includes left and right cover handle tabs 32, which are preferably arcuate at their outer edges, to facilitate manual grasping by the user, which are integrally molded with raised central rib 20. Preferably cover handle tabs 32 comprise a pair of centrally located outwardly extending cantilevered flanges, each cantilevered flange extending in a opposite direction to provide opposite gripping surfaces for manually handling the lid 52.

Figure 4:
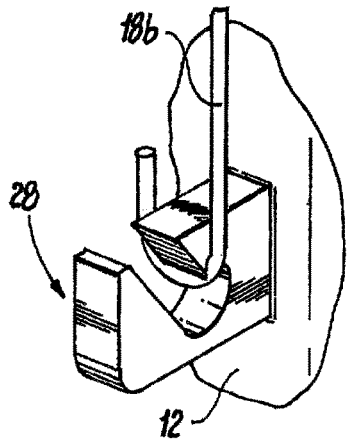
FIG. 4 is a local perspective view of a first optional bungee hook securement means, comprising a molded tab.

Rectangular barrel 54 also includes a barrel side handle 16, which can be either molded in place or it can be pivotable. Similarly, an optional quick-disconnect/connect bungee cord securement fastener 28 is optionally molded to one side of barrel 54, such as shown in FIG. 4, which mates with the proximal fastener end 18*a* of optional bungee cord 18. Likewise, the opposite distal fastener end 18*b* of optional bungee cord 18 is retained in eyelet 30 shown in close-up detail views of FIGS. 5 and 6, on an opposite side (not shown) of barrel 54, on the opposite side to securement fastener 28.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

I claim:

1. A removable retainer with a lid on a garbage can comprising, in combination:

said garbage can having a top opening surrounded by a first skirt with a smooth curved surface adjacent an upper edge thereof;

said lid comprising a cover portion having a downwardly extending second skirt with a smooth curved surface, descending from a peripheral edge thereof overlapping said first skirt when said lid is removably in place covering said top opening;

said cover portion having a handle comprising a raised central rib extending in a direction from one side of said lid to an opposite side of said lid; and, said central rib having opposite handle tabs formed therein along at least a portion of the length of said central rib, in which a groove is formed on each of opposite sides of upper edges of said smooth surfaced garbage can skirt, and a boss is mounted inside of said garbage can lid on each of opposite sides thereof, said grooves each receiving one of said bosses when said smooth surfaced skirt of said lid is placed over the top opening of said garbage can for locking said lid to said garbage can, said combination further comprising a bungee cord extending between opposite sides of said garbage can over said lid nested in a concave groove extending axially lengthwise within said raised rib of said lid for securing said lid on said garbage can against intrusion by animals, while allowing a user to remove said lid for emptying said garbage can, without said lid being pivotably attached and avoiding the lid from striking the user as the user is lifting the garbage can and dumping the contents therefrom.

2. The combination of claim 1 in which said bungee cord has a securement member at each end thereof, and a barrel portion of said garbage can has a fastener mounted on opposite sides thereof for removable engagement with the securement member at each end of said bungee cord.

3. The combination of claim 2 in which said bosses are located under distal ends of said of said raised central rib for aligning said central rib and bungee cord with said fasteners at opposite sides of said garbage can, and said bosses having convex cross sections corresponding to, and provided integral to, mirror image concave cross sections of at least portions of said concave groove of said cover lid.

4. The combination of claim 1 in which said garbage can is circular in cross section.

5. The combination of claim 1 in which said garbage can is rectangular in cross section.

6. The combination of claim 1 in which said raised central rib handle further comprises a pair of centrally located outwardly extending cantilevered flanges, each cantilevered flange extending in an opposite direction therefrom to provide opposite gripping surfaces for manually handling said lid.

7. The combination of claim 6 in which each said cantilevered flange extends outwardly in an arcuate shape.

8. The combination of claim 1 wherein said downwardly extending second skirt of said lid has a depth of about 4 to 5 inches.

9. The combination of claim 1 wherein said concave channel groove of said raised central rib has a width of about one half to three quarters of an inch.

10. A method of securing a removable a lid on a garbage can comprising the steps of:

providing said garbage can with a top opening surrounded by a first skirt with a smooth curved surface adjacent an upper edge thereof;

providing lid with a cover portion having a downwardly extending second skirt with a smooth curved surface descending from a peripheral edge thereof overlapping said first skirt when said lid is removably in place covering said top opening;

providing said cover portion with a handle comprising a raised central rib extending in a direction from one side of said lid to an opposite side of said lid; and, placing said lid over said top opening of said garbage can with said first skirt overlapping said second skirt;

in which a groove is formed on each of opposite sides of upper edges of said smooth surfaced garbage can skirt, and a boss is mounted inside of said garbage can lid on each of opposite sides thereof, said grooves each receiving one of said bosses when said lid is placed over the top opening of said garbage can for locking said lid to said garbage can;

further comprising the steps of:

securing ends of a bungee cord to opposite sides of said garbage can; and, placing said bungee cord over said cover portion with said bungee cord deployed in a concave groove extending axially lengthwise within said raised central rib, for securing said lid on said garbage can against intrusion by animals, while allowing a user to remove said lid for emptying said garbage can, without said lid being pivotably attached and avoiding the lid from striking the user as the user is lifting the garbage can and dumping the contents therefrom.

11. The method of claim 10 in which said bungee cord has a securement member at each end thereof, and a barrel portion of said garbage can has a fastener mounted on opposite sides thereof for removable engagement with the securement member at each end of said bungee cord, the fasteners mounted on said garbage can being aligned with said central rib.

12. The method of claim 11 in which said grooves each receiving one of said bosses when said lid is placed over the top opening of said garbage can for aligning said raised central rib and bungee cord with said fasteners at opposite sides of said garbage can, said bosses are located under distal ends of said raised central rib, for aligning said central rib and bungee cord with said fasteners at opposite sides of said garbage can, and said bosses having convex cross sections corresponding to, and provided integral to, mirror image concave cross sections of at least portions of said concave groove of said cover lid.

13. The method of claim 10 in which said garbage can is circular in cross section.

14. The method of claim 10 in which said garbage can is rectangular in cross section.

15. The method of claim 10 further comprising the step of providing said raised central rib handle with a pair of centrally located outwardly extending cantilevered flanges, each cantilevered flange extending in an opposite direction from to provide opposite gripping surfaces for manually handling said lid.

16. The method of claim 15 in which each said cantilevered flange extends outwardly in an arcuate shape.

17. The method of claim 10 further comprising the step of providing said downwardly extending second skirt of said lid with a depth of about 4 to 5 inches.

18. The combination of claim 10 further comprising the step of providing said concave channel groove of said raised central rib with a width of about one half to three quarters of an inch.

19. A method of securing a removable a lid on a garbage can comprising the steps of:

providing said garbage can with a top opening surrounded by a first skirt with a smooth curved surface adjacent an upper edge thereof;

providing said lid with a cover portion having a downwardly extending second skirt with a smooth curved surface descending from a peripheral edge thereof overlapping said first skirt when said lid is removably in place covering said top opening;

providing said cover portion with a handle comprising a raised central rib extending in a direction from one side of said lid to an opposite side of said lid, said central rib having a concave channel groove along a length of said central rib;

securing ends of a bungee cord to opposite sides of said garbage can, in which said bungee cord has a securement member at each end thereof, and a barrel portion of said garbage can has a fastener mounted on opposite sides thereof for removable engagement with the securement member at each end of said bungee cord, the fasteners mounted on said garbage can being aligned with said central rib;

placing said lid over said top opening of said garbage can with said first smooth surfaced skirt overlapping said second smooth surfaced skirt, in which a groove is formed on each of opposite sides of upper edges of said garbage can skirt, and a boss is mounted inside of said garbage can lid on each of opposite sides thereof, said grooves each receiving one of said bosses when said lid is placed over the top opening of said garbage can for aligning said raised central rib and bungee cord with said fasteners at opposite sides of said garbage can, and for locking said lid to said garbage can;

wherein said bosses are located under distal ends of said raised central rib;

further comprising the step of providing said raised central rib handle with a pair of centrally located outwardly extending cantilevered flanges, each cantilevered flange extending in a opposite direction from to provide opposite gripping surfaces for manually handling said lid, in which each said cantilevered flange extends outwardly in an arcuate shape;

further comprising the step of providing said downwardly extending second skirt of said lid with a depth of about 4 to 5 inches, and providing said concave channel groove of said raised central rib with a width of about one half to three quarters of an inch; and, placing said bungee cord over said cover portion with said bungee cord deployed in said concave groove for securing said lid on said garbage can against intrusion by animals, while allowing a user to remove said lid for emptying said garbage can, without said lid being pivotably attached and avoiding the lid from striking the user as the user is lifting the garbage can and dumping the contents therefrom.

20. A removable retainer with a lid on a garbage can comprising, in combination:

said garbage can having a top opening surrounded by a first skirt with a smooth curved surface adjacent an upper edge thereof;

said lid comprising a cover portion having a downwardly extending second skirt with a smooth curved surface, descending from a peripheral edge thereof overlapping said first skirt when said lid is removably in place covering said top opening;

said cover portion having a handle comprising a raised central rib extending in a direction from one side of said lid to an opposite side of said lid; and, said central rib having opposite handle tabs formed therein along at least a portion of the length of said central rib, and wherein the combination further comprises a bungee cord extending between opposite sides of said garbage can over said lid nested in a concave groove extending axially lengthwise within said raised rib of said lid for securing said lid on said garbage can against intrusion by animals, while allowing a user to remove said lid for emptying said garbage can, without said lid being pivotably attached and avoiding the lid from striking the user as the user is lifting the garbage can and dumping the contents therefrom.

21. The combination of claim 20 in which said garbage can is circular in cross section.

22. The combination of claim 20 in which said garbage can is rectangular in cross section.

23. The combination of claim 20 in which said raised central rib handle further comprises a pair of centrally located outwardly extending cantilevered flanges, each cantilevered flange extending in an opposite direction therefrom to provide opposite gripping surfaces for manually handling said lid.

* * * * *